United States Patent [19]

Luperti et al.

[11] Patent Number: 4,733,359

[45] Date of Patent: Mar. 22, 1988

[54] DOCUMENT COLLATING AND INSERTING SYSTEM HAVING DISPLAYS FOR DOCUMENT COUNT VERIFICATION

[75] Inventors: Harry E. Luperti, Bethel; Robert Irvine, Riverside, both of Conn.

[73] Assignee: Pitney Bowes Inc., Stamford, Conn.

[21] Appl. No.: 861,686

[22] Filed: May 9, 1986

[51] Int. Cl.[4] ..... B65B 5/06; B65B 65/08

[52] U.S. Cl. ..... 364/478; 53/500; 53/501; 53/507; 53/266 A

[58] Field of Search ..... 364/478, 183; 53/500, 53/266 A, 501, 507; 209/900

[56] References Cited

U.S. PATENT DOCUMENTS 3,935,429 1/1976 Branecky et al. ..... 209/900
4,077,181 3/1978 Asher et al. ..... 53/500

*Primary Examiner*—Jerry Smith
*Assistant Examiner*—Allen MacDonald
*Attorney, Agent, or Firm*—Lawrence E. Sklar; David E. Pitchenik; Melvin J. Scolnick

[57] ABSTRACT

A document collating and inserting system having displays for document count verification. A plurality of bank checks belonging to a check set are fed, counted and stacked at a stacking station while simultaneously an associated statement is fed to an imaging station where a number imprinted thereon is imaged by a video camera and displayed on a video monitor. The number represents a predetermined number which should equal the actual number of checks counted, the actual count also being displayed. An operator makes a visual comparison of the two displayed numbers and, if they are in agreement, initiates a cycle of the system thereby forming a collation of the statement and checks and transporting them to a holding station. From the holding station the collation is inserted within an envelope provided by an envelope feeder during the next cycle of the system. If the two numbers are not in agreement a mismatch switch is provided for the operator to activate before cycling the system. After indicating the mismatch the operator must remove the erroneous collation from the holding station in order to cycle the system once again. After removing the erroneous collation and cycling the system, an envelope is not provided by the envelope feeder, thereby avoiding the possibility of inadvertently postage metering and mailing an empty envelope.

30 Claims, 6 Drawing Figures

DOCUMENT COLLATING AND INSERTING SYSTEM HAVING DISPLAYS FOR DOCUMENT COUNT VERIFICATION

BACKGROUND OF THE INVENTION

I. FIELD OF THE INVENTION

This invention relates to document collating and envelope inserting systems and, more particularly, to such a system having a display means for displaying indicia provided on a summary document and a display means for displaying the count of a second document, whereby the count may be verified by an operator.

II. DESCRIPTION OF THE PRIOR ART

Document collating systems, especially those systems that are adapted for inserting the collated documents into an envelope for mailing, are widely used by a variety of industries for disseminating product and billing information. The high speed, virtually unattended operation of such systems has resulted in the automation of a traditionally slow and error prone-process, freeing the employees of such industries for more productive and creative labor.

One industry where such systems have proven beneficial is the banking industry, especially to those banks that provide checking accounts to their customers. The use of such a system allows the bank to automate the monthly check account cycle, whereby the bank mails each customer a statement which reflects the months's checking account activity. Included with the statement the bank typically returns to the customer are all of the customer's checks that were received and paid by the bank during the month. Normally, each check paid by the bank will also appear on the monthly statement within an itemized list of such checks, the list conveying certain other information such as the date a check was paid, the fluctuating amount of the balance in the account, and other financial data as is well known.

One important item of information included upon a checking account statement is a number which indicates the total number of a customer's checks paid by the bank during the month. This number should also indicate the number of paid checks enclosed with the statement, and serves as both an indicator to the bank of the accuracy of the statement and as an aid to the customer in verifying the accuracy of the financial data contained within the statement.

This number may be provided on the statement in several different formats, such as a bar code, or imprinted with magnetic ink, or simply as a number typed on the statement. If the number is provided as a bar code or is imprinted with magnetic ink the number is suitable for being read directly by the collating and envelope inserting system, if the system is equipped with a suitable reading mechanism. Also, if the system is equipped with a counting mechanism for counting the checks associated with each statement, the system may automatically compare the number appearing on the statement, representing the expected number of checks, to the actual number counted. Thus, it is possible for the system itself to verify the accuracy of the number of checks associated with each statement before the two document types are inserted into an envelope for mailing to the customer. If there is a disparity between the number appearing on the statement and the number of checks actually being sent to the customer, the system can automatically divert the statement and checks away from a path normally taken by the documents on their way to an envelope inserting station. The system can also indicate to an operator that an error has occurred. One such system of the prior art wherein the control of the system is effectuated by indicia provided on a document is shown in U.S. Pat. No. 3,935,429, said patent issued to the assignee of the present invention, said patent further being incorporated herein by reference.

As may be appreciated, such a number reading and verification mechanism can significantly increase the complexity and, hence, the cost of a collating and inserting system, thereby making the acquisition of such a system impractical for many smaller banks and financial institutions.

As is generally well known, there has been a proliferation of small banks and savings and loan institutions in this country in recent years. Since many of these banks and institutions provide checking services to their customers, the increase in the numbers of such banks and institutions has created a need for a lower cost collating and envelope inserting system. Such a system must provide a sufficient degree of automation to justify the purchase of the system, and yet not be priced beyond the reach of the small institution. A way to achieve this goal of producing a lower cost system is to provide a lesser degree of automation and, hence, require more operator involvement with the system. One such operator interaction is to verify that the number of paid customer checks to be enclosed with the statement agrees with the number indicated on the statement.

One such lower cost system of the prior art is shown in U.S. Pat. No. 4,077,181, said patent issued to the assignee of the present invention, said patent being incorporated herein by reference in its entirey. The inserting apparatus disclosed in the above named patent is comprised of a check feeder and stacker having a resettable counter for indicating the actual number of checks fed. The apparatus is also comprised of a bank statement folder and feeder which provides a bank statement associated with a set of fed checks.

In operation, the operator visually examines a predetermined number provided on the statement while the statement is held in a feeder hopper, thereby comparing the number to the value displayed by the check counter. If the two numbers are in agreement an insert switch is provided for activation by the operator, the activation of which causes the statement to be folded and fed, collated with the stack of checks, and conveyed by a transport belt to an envelope inserting machine to be inserted within an envelope. If the two numbers are not in agreement, the operator may remove and replace the checks within the check feeder to be recounted or, may remove the checks and associated statement for further study.

As may be appreciated, since the predetermined number provided on the statement must be viewed by the operator while the statement is still in the feed hopper, the operator may find such a method of viewing to be disadvantageous for several reasons. Firstly, the operator may find such a method of viewing to be physically uncomfortable and fatiguing, resulting in operator error in reading of the number. Secondly, it may be necessary for the operator to lean over the system to view the number, thereby possibly exposing the operator to safety hazards associated with the moving components of the system. Thirdly, because only one set of documents are processed at a given time, the overall operation may be time consuming.

SUMMARY OF THE INVENTION

A primary objective of the method and apparatus of the system of the present invention is to permit an operator to quickly, safely, and accurately verify that the actual number of documents to be mailed to a customer agrees with a predetermined number imprinted on the customer's summary document in order to ensure that each customer receives all of the documents during a mailing cycle and, additionally, that the customer does not inadvertently receive documents belonging to another customer.

This is accomplished in a preferred embodiment of the invention wherein a bank statement and paid checks are counted, verified, collated, and inserted in a mailing envelope by providing a video camera for imaging a number of other indicia representing a predetermined count of checks imprinted on a bank statement, the statement first being fed by a statement feeder to an imaging station disposed beneath the camera. The number imaged by the camera is displayed on a video monitor such that it may be readily viewed by the operator.

A counter having a numeric display for displaying the actual count of a set of checks fed by a high speed check feeder to a stacking station is also provided for viewing by the operator. By visually comparing the two displays the operator may determine if the two displayed numbers are equal. In one mode of operation of the system of the invention a set of checks are automatically fed to the stacking station by the high speed check feeder. The operation of the check feeder and the statement feeder occurring during a cycle of the system, wherein a pair of endless loop conveying chains having attached document pushers are also repositioned by one increment of travel.

If the operator determines that the two numbers are equal, or matched, a Cycle Switch is provided upon an operator control box for activating the system to execute one cycle, thereby causing the pair of transport chains and the plurality of document pushers attached thereto to be repositioned by one increment of travel. The movement of the pushers collates the statement and checks and positions them at a holding station. During a subsequent cycle of the system the collation at the holding station is transported by the pushers to an envelope flapping and feeding station where the collation is automatically inserted within an envelope, after which postage is applied to the envelope such as by a mailing machine, the envelope then being stacked by a power stacker for mailing. During a cycle of the system, and more specifically after the pushers have transported the collation to the holding station, the statement and check feeders automatically feed the next statement and associated set of checks.

In another mode of operation of the system of the invention the check feeder is inhibited from automatically feeding a set of checks during each cycle. Instead, a Check Feed Switch is provided on the operator control box for manually activating the check feeder to feed checks. In operation, the operator first determines by inspecting the imaged number displayed on the video display if the statement is associated with an active or inactive account. If the account is inactive the displayed number will be zero, thereby indicating that no checks are associated with the statement and, hence, the operation of the check feeder is not required during that cycle of the system. if the displayed number is greater than zero, the operator activates the Check Feed Switch, thereby feeding the set of check associated with the statement. The checks so fed are counted and the count displayed, as described above, to allow the operator to compare the displayed count and number provided on the statement.

In both of the above modes of operation, a Mismatch Switch is provided on the control box for activation by the operator when the two displayed numbers are not in agreement, or are unequal. A door disposed on an enclosure surrounding the stacking and holding station permits the operator access thereto for removal of the erroneous collation. In addition, the door permits the operator to remove oversized collations, that is, collations having a number of documents which exceed a predetermined number set into a count limit switch.

A valuable feature provided by the invention is an envelope feed inhibiting apparatus which disables the feeding of an envelope during a cycle of the system subsequent to a cycle wherein the operator has removed a collation from the holding station. Thus the wasteful action of postage metering an empty envelope is avoided.

In addition to the number of valuable features described above, the inserting and display system of the invention provides for the inclusion of additional document feeders for feeding advertising inserts and the like for collation and mailing with the checks and statement.

BRIEF DESCRIPTION OF THE DRAWINGS

The following description, taken by way of example, is best understood in conjunction with the accompanying drawings wherein.

DETAILED DESCRIPTION OF THE INVENTION

The document insertion and display system having displays for document count verification of the invention will herein be described as embodied within a system suitable for use in preparing a bank checking account statement and associated paid checks for mailing to a bank's customers. It should be realized, however, that the method and system of the invention may be suitable for a number of other applications. By way of example, a system embodying the invention would be suitable for preparing credit card statements, as when the credit card supplier includes with the statement a copy of each credit card receipt received during a billing period. Also the preferred embodiment of the invention will be described as having three insert feeders for feeding advertising inserts or similar documents, it being realized that alternative embodiments of the invention may have less or more than three insert feeders, or may have none at all.

Figure 1:
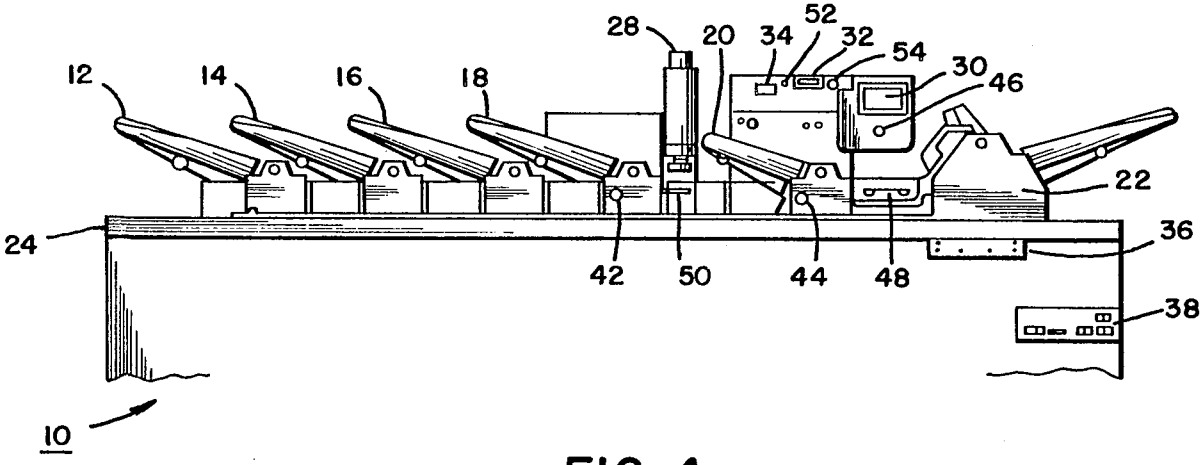
FIG. 1 shows a multiple station document collating and insertion system having an indicia display in accordance with the preferred embodiment of the invention.

Referring now to FIGS. 1 and 2 there is shown a multiple station document inserting system 10 having a plurality of document feeders 12, 14, 16, 18 and 20 and envelope feeder 22 mounted to a transport deck 24. Each of the feeders 12 through 20 and feeder 22 has a hopper for holding a plurality of documents to be fed, the hoppers being filled with their respective documents prior to the operation of the system 10. In the case of feeder 22 the hopper is filled with empty mailing envelopes. System 10 functions in general to feed documents from the hoppers of feeders 12, 14, 16, 18 and 20 such that the documents may be collated by a plurality of document pushers 26 attached to a pair of endless loop conveying chains 25 (one of which being shown in FIG. 2), the chains 25 running below and the pushers 26 extending upwards through deck 24. Sets of collated documents are fed to envelope feeder 22 to be inserted in an envelope, the enveope being sealed and conveyed to a mailing machine (not shown) to be meter stamped with the correct postage and stacked by a power stacker (not shown) for mailing. The overall system in which the invention is used may be a Model 8335 Bank Statement System manufactured by Pitney Bowes of Stamford, Conn., which includes a high speed feeder 20 which is used in place of a standard document feeder, such as feeders 12, 14, 16 and 18. In operation, high speed feeder 20 feeds a plurality of documents belonging to a document set, typically bank checks, during a cycle of system 10. A cycle of system 10 is defined herein as being the movement of the conveying chains 25 and pushers 26 from a first stationary position to a second stationary position, the second position being disposed a distance away in a direction towards envelope feeder 22, as will be discussed hereinafter. In addition, a cycle is further defined to include each of feeders 12, 14, 16 and 18 feeding a single document, feeder 20 feeding one or more documents and, additionally, the insertion of a set of collated documents from a previous cycle into an envelope under feeder 22.

In accordance with a preferred embodiment of the invention, system 10 is also comprised of a video camera 28 disposed such that it may image a summary docuemnt fed by feeder 18, the documen being, for example, a folded bank statement 51 having a predetermined number imprinted thereon. The number should correspond to the actual number of checks 55 fed by check feeder 20 during the machine cycle. In order to permit viewing by an operator of the number so imaged a video display 30 is coupled to the output of camera 28 in a manner well known in the art. As may be appreciated, a variety of imaging and display means may be utilized in alternative embodiments of the invention. Examples of such means include, but are not limited to mirrors, lenses, and fiber-optic bundles. Also in the alternative, other indicia may be used such as bar codes in conjunction with appropriate readers which display the predetermined count to the operator.

Since an object of the present invention is to permit the operator to rapidly and accurately verify that the predetermined number appearing on the statement corresponds to the actual number of checks fed during a machine cycle, a counter and numeric display 32 is coupled to an output of check feeder 20. The output of feeder 20 is an output of a document edge sensing device, typically one or more photocells (not shown), contained within feeder 20. Thus, during the operation of check feeder 20, display 32 will increment as each check is fed. Under ordinary conditions when the last check of a set of checks 55 is fed, the count displayed by display 32 will equal the actual count of checks fed during the cycle. Thus, by viewing the predetermined number displayed by video display 30 and the actual count displayed by numeric display 32, the operator may easily and quickly visually compare the two numbers. If the displayed numbers are equal, the operator causes the system 10 to execute a further cycle, thereby also transporting the statement and checks to a transparent check observation station 48, or "green house", for later insertion into an envelope. If the two numbers are not in agreement the operator is required to take other action, as will be discussed hereinafter.

A count limit switch 34 has an output which, in conjunction with counter and numeric display 32, will illuminate a Clear Collation Lamp 46 when a predetermined number of checks 55 have been fed by feeder 20, the predetermined number having been previously set into switch 34. Switch 34 in this embodiment of the invention is, preferably, a thumbwheel switch having two digits. The number set into switch 34 is determined by the maximum collation thickness which can be inserted within an envelope udner feeder 22. The thickness is normally given in units of panels, a panel being defined as a single check, or insert, or a fold of a folded statement. The number set into switch 34 is the difference between some maximum number of panels that the system can insert into an envelope, typically 70, and the number of panels comprising the inserts and statement. As an example, if a collation includes three single-panel inserts and a three panel folded statement, switch 34 would be set to 64 (70 less 6).

In order to permit the operator to control the operation of system 10, system 10 includes an operator control box 36 which has, in this embodiment, a number of pushbutton switches disposed thereon, the control box 36 being positioned such that the operator may readily activate the switches while observing the two aforementioned displays 30 and 32. Additionally, a console control panel 38 allows for energizing the system and for providing other functions which will be described below.

In addition to those components of system 10 that have been described above, FIG. 1 also shows a statement feeder switch 42 and check feeder switch 44. The purpose of each of these two switches 42 and 44 is to energize their corresponding feeders. In addition, switch 44 energizes camera 28 and displays 30 and 32, thus preparing system 10 for operation as an inserter for bank applications, which is a purpose of the invention. However, it should be realized that system 10 will also function as a standard inserter, that is, it will collate inserts from feeders 12, 14, 16, and 18 for insertion into an envelope in a continuous, unattended manner. If the standard mode of operation is desired high speed feeder is not energized by switch 44. Likewise, the control box 36 is not required, the operator instead utilizing the console control panel 38 to control the system 10 as is customary with similar standard inserter systems. The use of system 10 as a standard inserter is not considered to be an aspect of the invention, however, and will not further be described herein unless reference to a feature of the mode of standard operation may be useful as an aid in describing the operation of the invention.

Returning to FIG. 1, it can be seen that disposed beneath display 30 is the Clear Collation Lamp 46. When illuminated Lamp 46 provides an indication to the operator that a collation of documents at a holding station within the Check Observation Station 48 must be removed in order to continue operation of the system 10. Two further visual indicators are provided to alert the operator to various conditions present within system 10, namely a 100 Count Lamp 54 and an Overcount Lamp 52. Count Lamp 54 is illuminated when check feeder 20 feeds 100 checks without detecting a divider document. This condition causes feeder 20 to stop the feeding operation as 100 checks is approximately the maximum number that can be stacked at the stacking station beneath feeder 20. The 100 checks, and possibly more which are still to be fed are then, typically, manually inserted into a larger than normal envelope for mailing to the customer. Of course, the associated statement and inserts would also be included for mailing.

The aforementioned divider document is a document which has rectangular dimensions approximately equal to that of a check. Typically, the divider document has an imprinted pattern, such as two large black stripes, which is suitable for detection by one or more reflective-type photocells (not shown) which are disposed along a document feed path within feeder 20. Divider documents are used, typically, to separate sets of checks within the check holding drawers of the bank, each set of checks corresponding to a separate account and, hence, each such set requiring a separate monthly statement.

Overcount Lamp 52 provides a visual indication to the operator that the number preset into the count limit switch 34 has been exceeded by feeder 20, thereby requiring the operator to remove the oversized collation from the system 10 to be manually inserted into an envelope. This manual operation is required to prevent possible jamming or tearing of an envelope by the oversized collation during insertion under feeder 22.

As may be appreciated, for those situations which require the operator to remove the collation from system 10 for manual insertion into an evnelope, an envelope is not required to be fed under feeder 22 during the next cycle of system 10. If an envelope were fed the normal operation of feeder 22 would cause an empty envelope to be sealed and postage metered. To prevent such an occurrence, it is a feature of the invention to inhibit the feed of an envelope under feeder 22 in those situations where the operator has physically removed a collation during the previous cycle of the system 10. The method of implementing this feature of the invention will be described below.

In order to gain a better understanding of the invention reference is now made to FIG. 2 wherein the placement of various components of the system 10 is shown.

Figure 2A:
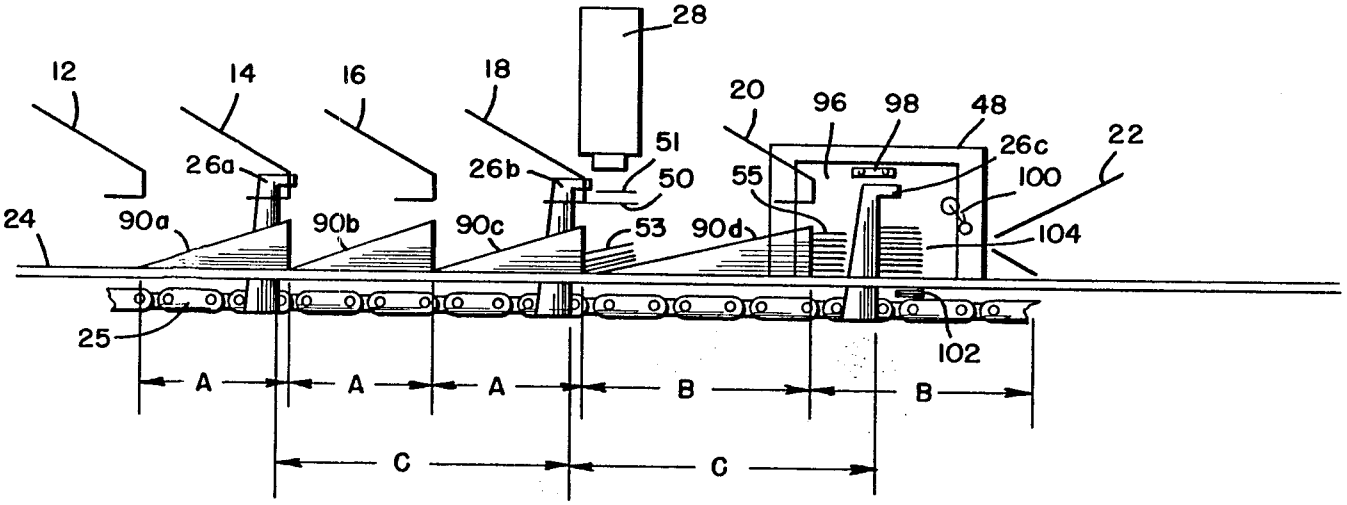
FIG. 2 is a stylized representation of the system of FIG. 1 wherein the spacing between the various components of the system is shown.

Referring first to FIG. 2a the transport deck 24 is shown to have a plurality of ramps 90*a*, 90*b*, 90*c* and 90*d* disposed thereon, the ramps 90 further being disposed between feeders 12, 14, 16, 18 and 20. In operation a document, such as an insert, fed from feeders 12, 14 and 16 will be deposited on a lower end of ramps 90*a*, 90*b* and 90*c*, respectively. A ledge 50 disposed beneath statement feeder 18 is positioned such that a folded statement 51 fed from feeder 18 will be deposited on ledge 50. Camera 28 is positioned relative to ledge 50 such that the number provided on statement 51 may be imaged by camera 28 for display by video display 30.

As may be seen, the length of each ramp 90*a*, 90*b* and 90*c* is such that it is approximately equal to the spacing between adjacent feeders, the length being shown as the dimension A. In this embodiment of the invention the dimension A is approximately 13.5 inches. As may further be seen, the spacing between feeder 18 and check feeder 20, and between feeder 20 and feeder 22 has the dimension shown as B. In this embodiment of the invention the dimension B is approximately 20.25 inches, or one and one half times that of the dimension A. The significance of the difference between dimensions A and B is best understood by reference to the dimension shown as C in FIG. 2*a*, the dimension C being indicative of the spacing between adjacent document pushers 26. In this embodiment of the invention the dimension C is approximately 27 inches, or twice that of dimension A. The dimension of 27 inches also defines the distance traveled by pushers 26 during a cycle of system 10.

Thus, it can be seen that the above described spacing between the various components of the invention results in pusher 26*c* being positioned, when the transport chain 25 is at rest, in a region between feeder 20 and feeder 22. This is within the area of the aforementioned check observation station 48 and, more specifically, is within an area between the aforementioned stacking and holding stations. Observation station 48 includes a door 96 having a handle 98 for allowing the operator to remove, if required, a final collation 104 from the holding station. Door 96 further has a micro-switch 100 connected thereto, the micro-switch 100 having an output for indicating the opening and closing of door 96.

A photocell 102 is disposed beneath an opening (not shown) within deck 24 at a position such that it underlies the holding station and final collation 104. Photocell 102 has an output (not shown in FIG. 2*a*) for indicating the presence or absence of collation 104, the presence of a collation obscuring light emanating from a light source (not shown), which light is normally sensed by photocell 102.

Figure 2B:
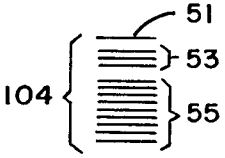

Referring to FIG. 2*b* it can be seen that collation 104 is formed in a specific manner, that is, the plurality of checks 55 are disposed beneath a plurality of inserts 53 which in turn lie beneath the statement 51. This ordering of documents is important in that the customer name and addess are provided, typically, on the statement. Thus, when the collation 104 is correctly inserted within an envelope of the type having a clear window therein, the customer's name and address are clearly visible through the window.

In order to accomplish this specific ordering of collation 104 it is necessary to gain an understanding of the operation of pushers 26 and the ramps 90 during a cycle of system 10. As can be seen in FIG. 2*a*, pushers 26 extend upwards through ramps 90, passing through slots (not shown) made therein. As an example, during a cycle of system 10 pusher 26*a* will travel a distance of 27 inches, thereby transversing through the slots within ramps 90*b* and 90*c*. The feeders 12, 14, and 16 are controlled such that each will feed one insert after the arrival of pusher 26*a*. Therefore pusher 26*a*, which had previously collected the insert from feeder 12 will transport that insert and the insert fed from feeder 14 during the last cycle upwards along ramp 90*b*. When pusher 26*a* reaches the end of ramp 90*b*, the two inserts being pushed will drop down upon the insert previously fed from feeder 16. Pusher 26*a* will continue to move along deck 24 until the inserts being pushed reach the end of ramp 90c, at which time they will drop down and be positioned below the statement ledge 50. Pusher 26a ceases motion at this time. As shown in FIG. 2a, a collation of inserts 53 is comprised of the three inserts collected from feeders 12, 14 and 16. As has been previously described, ledge 50 is disposed relative to feeder 18 such that the statement 51 fed by feeder 18 is fed to ledge 50 instead of deck 24. Ledge 50 is further disposed relative to camera 28 such that the indicia or number imprinted on the statement 51 is imaged by camera 28 for displaying by video display 30.

During the next cycle of system 10 pusher 26a, which for the purpose of this example is now positioned just in front, or upstream, of ledge 50, will move forward. Pusher 26a is of such a height that it extends vertically above ledge 50 to pass through a slot (not shown) made in ledge 50. As an upper portion of pusher 26a passes across an upper surface of ledge 50 the statement 51 disposed thereon will be pushed off of ledge 50 and will drop down on top of the plurality of inserts 53 being simultaneously pushed by pusher 26a below ledge 50. Thus, a "leapfrogging" of the statement on top of the inserts 53 is accomplished. The statement 51 and underlying inserts 53 are further pushed up ramp 90d by pusher 26a until they are caused to drop off of the end of ramp 90d and onto the plurality of checks 55 previously fed during this cycle by feeder 20, thereby forming the final collation 104. Pusher 26a continues in motion until it comes to rest with the final collation 104 disposed over photocell 102, this position being at the aforementioned holding station. Normally, during the next cycle of system 10 pusher 26a will push final collation 104 under feeder 22 for insertion within an envelope.

Figure 5:
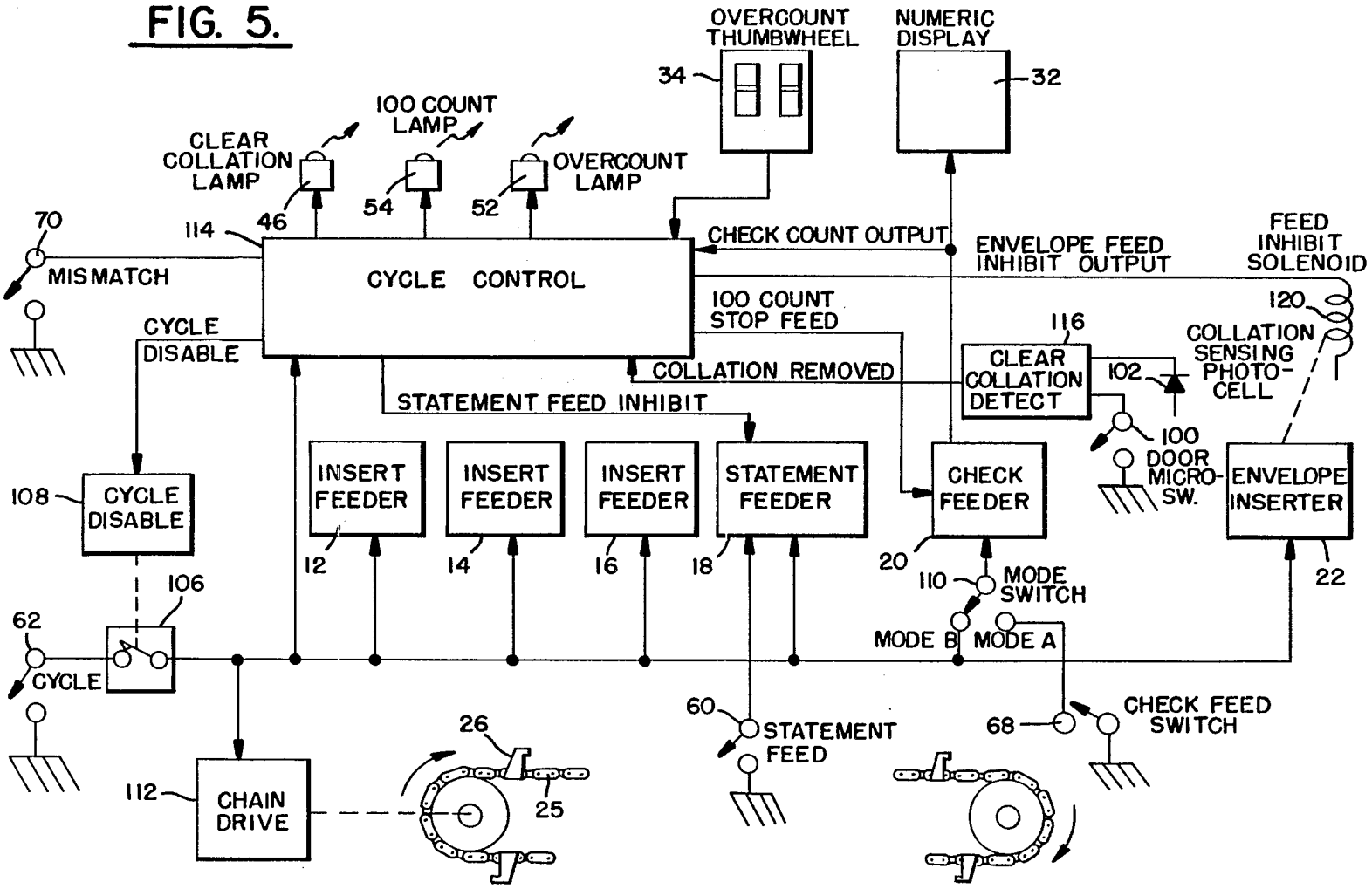
FIG. 5 is a block diagram illustrating the interconnection of some of the components of the system of FIG. 1.

To better understand the operator interaction with system 10 it is advantageous to describe the operator controls, namely those contained upon console control panel 38 and operator control panel 36, in conjunction with the block diagram of FIG. 5.

Figure 3:
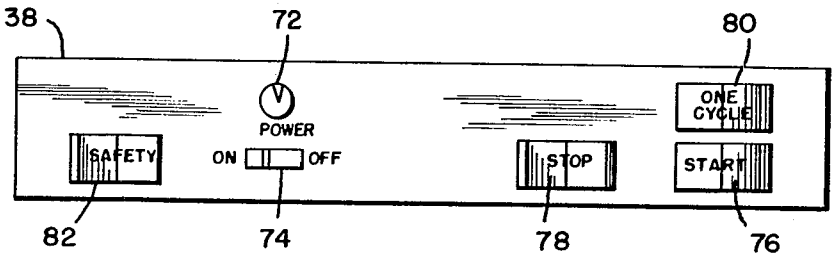
FIG. 3 shows the operator controls which are disposed upon the system control panel of the system of FIG. 1.

Referring to FIG. 3, the console control panel 38 is shown. Disposed upon panel 38 is a Power On Lamp 72 which is illuminated when Main Power Switch 74 is switched to the On position, thereby applying power to system 10. Start Switch 76, which must be depressed in conjunction with Safety Switch 82, causes the continuous motion of the conveying chain, the continuous synchronized feeding of documents by feeders 12, 14, and 16 and 18, and the operation of inserter 22 during the aforementioned standard mode of operation. One Cycle Switch 80, depressed in conjunction with Safety Switch 82, causes the chain and attached pushers to travel a certain distance, which distance in this embodiment of the invention is 27 inches. One Cycle Switch 80 is typically used when initially preparing the system 10 to enter the standard mode of operation, the One Cycle Switch 80 incrementally advancing the chain and pushers while also causing each feeder to feed one document onto transport deck 24. Thus, a collation of documents is eventually positioned adjacent to feeder 22. When a complete collation of documents has been so positioned, the Start Switch 76 is depressed, thereby initiating the continuous chain motion of the standard mode of operation, as described above. In order to terminate the standard mode of operation a Stop Switch 78 is provided, the depression of which halts the operation of the system.

Figure 4:
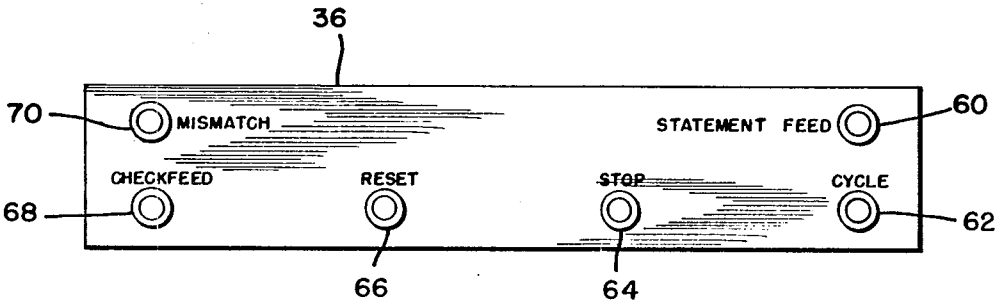
FIG. 4 shows the operator controls which are disposed upon the operator control box of the system of FIG. 1.

The switches of console panel 38 function identically when the system 10 is utilized, in accordance with the invention, in the bank mode of operation. However, in order to implement the new and useful functions of the invention a separate control panel is required, namely the operator control box 36. As shown in FIG. 4, box 36 has a plurality of push button switches disposed thereon for activation by the operator. A Statement Feed Switch 60 is provided for manually causing statement feeder 18 to feed one or more additional statement pages, as is required when the statement page that is automatically fed is not the first page of a multipage statement. Since the predetermined number corresponding to the number of checks associated with the statement appears on the first, or address bearing, page of a multipage statement, it may be necessary for the operator to depress the Statement Feed Switch 60 one or more times in order to feed the entire multipage statement such that the number may be viewed on display 30. Cycle Switch 62 is identical in function to One Cycle Switch 80, in that it causes the system 10 to execute one cycle of operation. Inasmuch as the system 10 of the invention is intended to be operated in a semiautomatic versus a continuous fashion, the Cycle Switch 62 is used by the operator to cycle, or advance, the system after the operator completes the verification of the two numbers appearing on displays 30 and 32, thereby initiating a new verification cycle. A Stop Switch 64 functions identically to Stop Switch 78, that is it causes the system 10 to stop operation. Reset Switch 66 resets the system. Depression of Reset Switch 66 is required after the depression of either Stop Switch 64 or 78 before the depression of Safety Switch 82 and Start Switch 76 in order to resume operation. A Check Feed Switch 68 causes feeder 20 to feed the next consecutive set of checks. Switch 68 is required in that the system 10 of the invention is capable of operation in one of two modes, namely a Mode A and a Mode B.

The mode of operation is set by a Mode Switch 110 which is provided within system 10. Mode A is selected when it is known that some statements are associated with inactive accounts, that is, accounts for which no checks are received for payment during the current statement cycle. As may be appreciated, if a statement and a set of checks are automatically fed during each machine cycle, eventually a set of checks will be fed simultaneously with a statement which is associated with an inactive account. This occurrence would require the operator to either replace the checks within the hopper of feeder 20 such that they may be refed on the next cycle, or perform some other manual, time consuming task to prevent the set of checks so fed from being mailed with the statement associated with the inactive account. In order to overcome this problem, when the Mode A of operation is selected, the automatic operation of check feeder 22 is inhibited, resulting in only a statement and inserts being automatically fed during each machine cycle. The operator, by observing display 30, determines if the number appearing on the statement indicates that the statement is associated with an active or an inactive account. If the number indicates that the account is active, that is, that there are checks associated with the account, the operator depresses the Check Feed Switch 68. Depressing Switch 68 causes high speed feeder 20 to rapidly feed the next set of checks. The operator then compares the numbers appearing in displays 30 and 32, as has been described above.

If display 30 indicates, however, that the statement is associated with an inactive account, the operator would not depress the Check Feed Switch 68. Instead, the Cycle Switch 62 would be depressed in order to transport the statement and inserts to the holding station. Thus, only the statement and inserts are transported to feeder 22 for mailing on the subsequent cycle of system 10.

The Mode B of operation is selected when it is known beforehand that no statements associated with inactive accounts are included within the plurality of statements loaded within feeder 18. Operation of the system 10 in the Mode B of operation causes feeder 20 to automatically feed a set of checks during each cycle, each such set separated by a divider document, it being assumed that each statement has a corresponding set of checks. A set of checks can include one or more checks, depending on the amount of activity in the account during the previous monthly cycle.

A Mismatch Switch 70 is also provided on control box 36 for indicating to the system 10 that a mismatch set of checks has been detected, that is, that the expected number of checks, as indicated by the predetermined number appearing on display 30, is not in agreement with the actual number of checks fed, as indicated by display 32. Activation of Switch 70 by the operator is performed, typically, immediately before the activation of the Cycle Switch 62. Activation of Cycle Switch 62 at this time causes the system 10 to execute one cycle, as has been described, thereby collating the statement 51, inserts 53, and checks 55 into a final collation 104, positioning the final collation 104 over photocell 102 and, additionally, causing feeders 12, 14, 16, 18 and 20 to feed documents such that the next verification cycle may be performed. At the completion of this cycle the Clear Collation Lamp 46 is illuminated by a Cycle Control 114 and, additionally, Control 114 disables Cycle Switch 62 by opening the normally closed contacts 106 of a Cycle Disable Device 108. Thus, the operator is prevented from inadvertently activating the Cycle Switch 62 once again, which activation would cause the erroneous collation currently positioned at the holding station over photocell 102 to be transported under feeder 22 and inserted into an envelope for mailing. In order to extinguish the Clear Collation Lamp 46 and reenable Cycle Switch 62 it is necessary for the operator to open door 96, which opening is indicated by microswitch 100, and remove the erroneous collation, which removal is indicated by photocell 102. Upon the operator's closing of door 96 a Clear Collation Detect 116 circuit indicates to Cycle Control 114 that the collation has been removed. Control 114 extinguishes the Clear Collation Lamp 46 and causes contacts 106 to close, thereby enabling the operation of Cycle Switch 62 so that the documents already positioned at the imaging station and stacking station may be collated after their count verification is accomplished.

During the above described cycle of system 10 wherein the erroneous collation was transported to the holding station, feeders 12 through 20 operated, as has been described, to feed their respective documents, thereby causing a statement 51 to be fed and the number thereon to be imaged by camera 28 and displayed on display 30. In addition, a plurality of checks were fed by feeder 20, the actual number of checks so fed being displayed on display 32. Thus, after removing the erroneous collation, the operator may once more make the visual comparison of the two displayed numbers. If the displayed numbers are in agreement the Cycle Switch 62 is activated by the operator. If the displayed numbers are not in agreement the Mismatch Switch 70 and the Cycle Switch 62 are activated by the operator. In either case, the activation of the Cycle Switch 62 causes a collation, if present, above photocell 102 o be transported under feeder 22 for insertion within an envelope. As may be appreciated, following a cycle wherein the Mismatch Switch 70 was activated and the final collation removed from the system 10, an envelope is not required to be provided by feeder 22.

Two other situations may occur during the operation of system 10 that also do not require an envelope to be provided by feeder 22. One of these situations occurs when the number of checks fed by feeder 22 exceeds the overcount number set into switch 34, but does not exceed the 100 check limit of feeder 20.

If this condition occurs Overcount Lamp 52 is illuminated by Control 114 for indicating the overcount condition to the operator. In response, the operator depressed the Cycle Switch 62 to form a final collation 104. The operation of system 10 after activation of the Cycle Switch 62 is then substantially identical to the operation, as described above, as if the Mismatch Switch has been depressed in the previous cycle, that is, the Clear Collation Lamp 46 is illuminated and the Cycle Switch 62 is disabled. The removal of the oversized final collation 104 by the operator, as indicated to the Cycle Control 114 by Clear Collation Detect 116, causes Control 114 to extinguish both the Overcount Lamp 52 and the Clear Collation Lamp 46, and additionally, to reenable Cycle Switch 62.

A second, similar situation occurs when the number of checks fed during a cycle equals 100. At this time the operation of feeder 20 is halted by Control 114 and the 100 Count Lamp 54 is illuminated. Activation of the Cycle Switch 62 causes a partial collation to be positioned over photocell 102, the partial collation containing the 100 checks, inserts 53, and statement 51. The Clear Collation Lamp 46 is illuminated and the Cycle Switch 62 is disabled as has been described above. Additionally, this activation of the Cycle Switch 62 causes feeder 20 to feed the remainder, if present, of the set of checks, that is, those checks in excess of 100. At this time the operator would remove the partial collation from the holding station, as has been described above.

A feature of the invention is to disable the feeding of a statement 51 during this time in order to allow the remainder of the set of checks to be fed and removed for manual collation and insertion within an oversized envelope. The disabling of statement feeder 18 is accomplished by Control 114 activating a Statement Feed Inhibit output during a cycle following a 100 count condition.

In order to remove the remainder of the checks the operator activates the Cycle Switch 62 once more. The remaining checks of the set of checks previously fed are transported to the holding station, the Clear Collation Lamp 46 is illuminated and the Cycle Switch 62 is once more disabled until the operator removes the remainder of the checks for manual envelope insertion. Upon closing door 96 the system is operable to resume normal operation.

Figure 6:
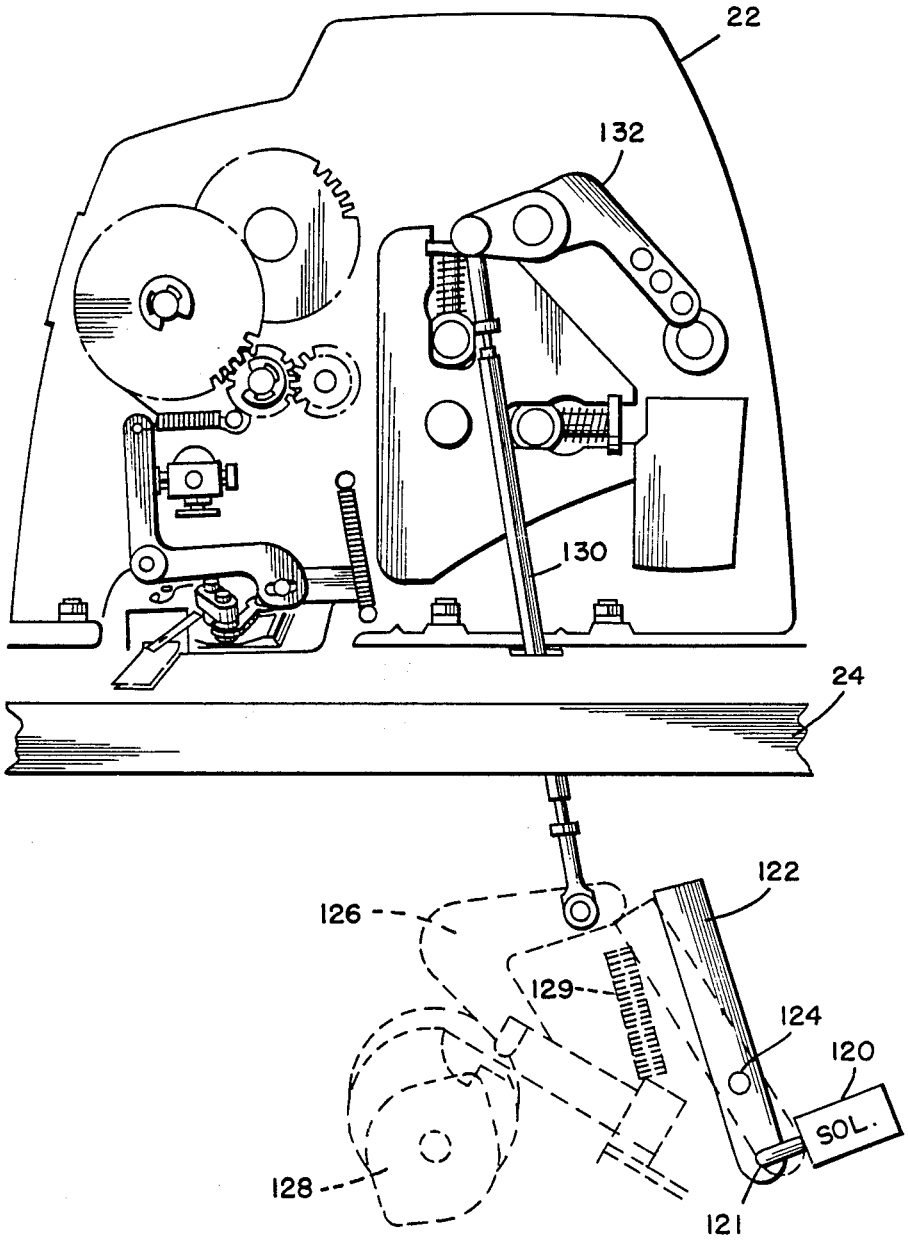
FIG. 6 is a side, cutaway view of a portion of the envelope inserter of the system of FIG. 1, showing the envelope feed inhibiting mechanism which is a feature of the preferred embodiment of the invention.

Referring now to FIG. 6 there is shown a portion of envelope feeder 22 having a preferred embodiment of the envelope feed inhibiting mechanism of the invention. The construction and operation of feeder 22 is similar to that disclosed in U.S. Pat. No. 2,766,569, said patent issued to the assignee of the present invention, said patent further incorporated herein by reference in its entirely.

As seen in FIG. 6, a feed inhibit solenoid 120 of a well-known construction includes a spring-loaded plunger 121 operable for linear movement, the movement being inward towards solenoid when solenoid 120 is energized by a suitable voltage. Similarly, when solenoid 120 is deenergized the movement of plunger 121 is outwards, that is, away from solenoid 120. Attached at one end of plunger 121 is a pawl 122 operable for rotation about a pin 124, pin 124 being affixed to a suitable supporting structure (not shown).

In operation, if solenoid 120 is deenergized pawl 122 assumes the position indicated by the solid line of FIG. 6. Conversely, when solenoid 120 is energized, the inward movement of plunger 121 causes pawl 122 to rotate about pin 124, thereby assuming the position indicated by the dashed line of FIG. 6. Pawl 122 is disposed relative to a spring-tensioned oscillating comb lever 126 such that when solenoid 120 is energized, an end of pawl 122 opposite the end attached to plunger 121 is brought under an end of the oscillating comb lever 126.

During the normal operation of inserter 22 comb level 126 is given an oscillatory motion by a 360° rotation of an oscillating comb cam 128 in conjunction with tensioning spring 129, the comb cam 128 executing one 360° revolution during each cycle of system 10. Attached to comb lever 126 is an oscillating comb rod 130 which conveys the oscillating motion of comb lever 126 to a lever 132. Lever 132 forms a portion of the mechanism of feeder 22 which feeds an envelope (not shown) to a demand feed roller (not shown), whereby the envelope is fed, flapped (or opened), and positioned such that a collation may be inserted therein. The detailed operation of such an envelope feeder is described in U.S. Pat. No. 3,049, 845, said patent issued to the assignee of the present invention, said patent further incorporated herein by reference in its entirety.

As may be appreciated, when solenoid 120 is energized by Cycle Control 114, thereby causing pawl 122 to abut under comb lever 126, the oscillating motion of comb lever 126 is inhibited. Thus, the motion of comb rod 130 and lever 132 is also inhibited, resulting in an envelope not being fed from the demand feed roller. In operation, during a cycle of the system 10 when a condition has occurred, such as a mismatch or an overcount or a 100 count, that requires the operator to remove the collation from the holding station, Control 114 applies a suitable voltage to solenoid 120 to energize the solenoid. Energizing solenoid 120 causes pawl 122 to disable the oscillatory motion of comb lever 126 during the next cycle of system 10. Inasmuch as there is no collation present at the holding station, the collation having been removed by the operator, disabling comb lever 126 prevents the feed of an envelope during this cycle. At the completion of this cycle. Control 114 removes the energizing voltage from solenoid 120, thereby causing pawl 122 to return to the position where it is no longer under the end of comb lever 126, thus enabling feeder 22 to feed an envelope during the next cycle.

As may be seen, a novel system and method of verifying that a required number of documents, such as checks, are associated with a summary document, such as a statement, before mailing has been disclosed. It should be appreciated that the system and method of the invention are suitable for a variety of applications beyond the bank checking account application described above. It should be further appreciated that the above described embodiments of the invention are illustrative only and that modifications thereof may occur to those skilled in the art. Accordingly, this invention is not to be regarded as limited to the embodiments disclosed herein, but as to be limited only as defined by the appended claims.

What is claimed is:

1. A document count verification system in which the actual count of documents in a document set can be compared against the predetermined count of documents in the document set by a system operator, the predetermined count residing on a summary document, said system having means for counting the documents in the document set and displaying the count to the operator, said system also having a holding station for the documents after they are counted, said system comprising:

means for displaying the predetermined count to the operator;

cycle initiation means through which the operator initiates the counting of the documents in the document set, display of the count, and display of the predetermined count; and mismatch set indicator means operable by the operator to indicate that the actual count as displayed to the operator is unequal to the predetermined count as displayed to the operator which inhibits a subsequent document set from reaching the holding station until the operator removes the mismatch set of documents from the holding station.

2. The system as defined in claim 1 comprising:

means for collating the document set and the summary document to form a final collation thereof.

3. The system as defined in claim 2 comprising:

conveyance means for conveying the final collation to the holding station.

4. The system as defined in claim 3 comprising:

a supply of envelopes;

an envelope feeding station removed from said holding station;

feed means for feeding an envelope from said supply of envelopes into said envelope feeding station; and means for inserting the final collation into the envelope.

5. The system as defined in claim 4 comprising envelope feed inhibit means responsive to operation of said mismatch set indicator means for inhibiting said envelope feed means.

6. The system as defined in claim 1 wherein a divider document is interposed between successive document sets to indicate the end of a set, and wherein said means for counting includes means for detecting a divider document interposed between successive document sets.

7. The system as defined in claim 6 wherein said means for detecting includes means operable for stopping said counting means, said detecting means being responsive to the presence of a divider document to operate said stopping means.

8. The system as defined in claim 1 wherein said holding station includes an enclosure for enclosing said holding station, said enclosure further having a door for opening and closing by the operator, said door permitting the operator to remove the mismatched set therethrough, said door further having an indicator means connected thereto, said indicator means having an output for indicating to said system whether said door is open or closed.

9. The system as defined in claim 8 wherein said holding station is further comprised of a document set sensor means disposed such that the presence or absence of a document set may be sensed by said sensor means, said sensor means having an output operable, in conjunction with said indicator means output, for indicating to said system when the document set has been removed from said holding station by the operator.

10. A check count verification system wherein checks associated with a statement form a check set, one or more check sets being located within a check hopper, means for imaging pre-determined count indicia provided on the statement for viewing by an operator wherein the operator initiates a cycle for count verification of individual ones of the check sets and is able to remove a mismatched document set whose actual count is unequal to the pre-determined count, comprising:

means for displaying said imaged predetermined count indicia, said means suitable for viewing by the operator;

first means for feeding the statement to an imaging station, said station being disposed relative to said imaging means such that said indicia may be imaged for display by said means for displaying;

second means for feeding one or more checks as contained in said check set from said hopper to a stacking station, said second feeding means having counting means for individual ones of said checks in said check set as they are fed to determine said actual count;

count display means responsive to said counting means for displaying said actual count for viewing by the operator;

transport means for conveying said statement to said check set to collate said statement with said check set at said stacking station to form a final collation, said transport means further being operable for conveying said final collation to a holding station;

first control means adapted for activation by the operator for controlling the initiation of said cycle for count verification of individual check sets, said first control means upon activation causing said transport means to convey any said final collation in said stacking station from said stacking station to said holding station, and initiating said first means for feeding said statement and said second means for feeding one or more checks pertaining to another check set for display and counting; and second control means for inhibiting said first control means adapted for activation by the operator when the mismatched document set is detected, said second control means inhibiting said first control means after said mismatched set is conveyed to said holding station and until said mismatched document set is removed therefrom by the operator.

11. The system as defined in claim 10 comprising:

a supply of envelopes;

an envelope feeding station removed from said holding station;

feed means for feeding an envelope from said supply of envelopes into said envelope feeding station; and means for inserting the final collation into the envelope.

12. The system as defined in claim 11 wherein said transport means is operable for conveying the final collation from said holding station to said feeding station whereby the final collation is inserted into the envelope.

13. The system as defined in claim 10 wherein a divider document is interposed between successive check sets to indicate the end of a check set, and wherein said means for counting includes means for detecting a divider document interposed between successive check sets.

14. The system as defined in claim 13 wherein said means for detecting includes means operable for stopping said counting means, said detecting means being responsive to the presence of a divider document to operate said stopping means.

15. The system as defined in claim 14 comprising:

an overcount value setting means; and an overcount detection means responsive to a setting of said overcount value setting means and to said counting means, said overcount detection means operable for identifying the final collation as being an overcount collation having an overcount check set having an actual count equal to or greater than said setting.

16. The system as defined in claim 15 wherein said overcount detection means is operable for inhibiting the operation of said first control means after the overcount collation is conveyed to said holding station and until the overcount collation is removed therefrom by the operator.

17. The system as defined in claim 16 and further comprising:

maximum count detection means responsive to said counting means for identifying the final collation as being a maximum count collation having a maximum count check set which has an actual count equal to a predetermined maximum count, said maximum count detection means operable for inhibiting the operation of said first control means after the maximum count collation is conveyed to said holding station and until the maximum count collation is removed therefrom by the operator.

18. The system as defined in claim 17 comprising:

envelope feed inhibit means operable for inhibiting said envelope feed means from feeding said envelope, said envelope feed inhibit means being responsive to an activation of said second control means, said inhibit means further being responsive to said overcount detection means and to said maximum count detection emans so that when said mismatched document set or said overcount collation or said maximum count collation is removed by said operator said envelope feed means is inhibited from feeding an envelope.

19. The system as defined in claim 18 wherein said holding station includes:

an enclosure;

a door moveably mounted on said enclosure for gaining access to said holding station, said door being moveable between an open position and a closed position;

indicator means operated by said door to sense the condition of the door; and whereby the operator is able to remove the mismatched document set or said overcount collation or said maximum count collation from said holding station.

20. The system as defined in claim 19 wherein said holding station includes a final collation sensor means disposed such that the presence or absence of the final collation may be sensed by said sensor means, said sensor means operable, in conjunction with said indicator means for indicating to said system when the final collation has been removed from said holding station by the operator.

21. The system as defined in claim 10 comprising:

statement feed control means adapted for activation by said operator for causing said first means for feeding to feed said statement whereby a multipage statement may be fed in its entirety so that said indicia may be imaged.

22. The system as defined in claim 10 comprising;

mode control means adapted for activation by said operator, said mode control means operable for selecting two modes of operation of said second means for feeding wherein a first mode of said two modes causes said second means for feeding to feed the check set substantially simultaneous with said first means for feeding and, wherein a second mode of said two modes disables said second means for feeding from feeding the check set substantially simultaneously with said first means for feeding.

23. A system as defined in claim 22 comprising:

check feed control means adapted for activation by the operator, said check feed control means operable for causing said second means for feeding to feed the check set when said mode control means selects said second mode and the operator activates said check feed control means.

24. The system as defined in claim 10 comprising:

one or more document feeders for feeding additional documents for collation with said statement and said check set.

25. The system as defined in claim 10 wherein said imaging means is a video camera and wherein said display means is a video monitor.

26. A method for verifying a document set count in which the actual count of documents in said document set can be compared against the predetermined count of documents in the document set by a system operator, the predetermined count residing on a summary document, comprising the steps of:

initiating a verification cycle;

feeding the summary document to a predetermined count imaging station;

displaying the predetermined count;

feeding each document in the document set to a stacking station;

counting the documents to generate the actual document set count as they are being fed;

displaying the actual count;

transporting at the end of a verification cycle the summary document from the imaging station to the stacking station;

collating the summary document with an associated document set; and indicating a mismatched set prior to initiating a subsequent verification cycle in response to the operator determining that the actual count does not match the predetermined count, said mismatch switch inhibiting the further transporting of final collations from said stacking station to said holding station until the operator removes the mismatched set from said holding station.

27. A method as defined in claim 26 wherein said step of transporting further comprises the steps of:

conveying the final collation at said holding station to an envelope feeding station; and inserting the final collation within an envelope for mailing.

28. A method as defined in claim 27 wherein said step of inserting further comprises the step of feeding an envelope prior to inserting the final collation therein.

29. A method according to claim 28 further comprising the step of removing the mismatched set from said holding station to prevent the mismatched set from being conveyed to said inserting station and inserted within an envelope for mailing.

30. A method according to claim 29 further comprising the step of inhibiting the step of feeding an envelope during a verification cycle initiated immediately subsequent to said step of removing.

* * * * *